US005914443A

United States Patent [19]

Kalum

[11] Patent Number: 5,914,443

[45] Date of Patent: Jun. 22, 1999

[54] ENZYMATIC STONE-WASH OF DENIM USING XYLOGLUCAN/XYLOGLUCANASE

[75] Inventor: Lisbeth Kalum, Værløse, Denmark

[73] Assignee: Novo Nordisk A/S, Bagsværd, Denmark

[21] Appl. No.: 09/066,117

[22] Filed: Apr. 23, 1998

Related U.S. Application Data

[60] Provisional application No. 60/045,388, May 20, 1997.

[30] Foreign Application Priority Data

Apr. 28, 1997 [DK] Denmark ..... 0468/97

[51] Int. Cl.[6] ..... D06M 16/00

[52] U.S. Cl. ..... 8/401; 8/102; 8/114; 8/115; 8/138; 435/263

[58] Field of Search ..... 8/401, 102, 114, 8/115, 138; 435/263

[56] References Cited

U.S. PATENT DOCUMENTS 5,268,002 12/1993 Olson et al. ..... 8/102

FOREIGN PATENT DOCUMENTS

| | | |
|---|---|---|
| 0 011 434 | 5/1980 | European Pat. Off. . |
| 0 011 951 | 6/1980 | European Pat. Off. . |
| 2 233 352 | 1/1991 | United Kingdom . |
| 2276178 | 9/1994 | United Kingdom . |
| WO 95/35382 | 12/1995 | WIPO . |
| WO 96/05353 | 2/1996 | WIPO . |

OTHER PUBLICATIONS

Abstract; File 67, Dialog Accession No. 8304096, May 1983.

*Primary Examiner*—Alan Diamond
*Attorney, Agent, or Firm*—Steve T. Zelson, Esq.; Reza Green, Esq..

[57] ABSTRACT

A new method of manufacturing a fabric or a garment with a stone-washed or worn look, the method comprising coating the yarn or fabric or garment with a polymer, e.g. a xyloglucan, prior to dyeing and afterwards creating the abraded or worn look by enzymatic degradation of said polymer, e.g. by using a xyloglucanase.

31 Claims, No Drawings

ENZYMATIC STONE-WASH OF DENIM USING XYLOGLUCAN/XYLOGLUCANASE

CROSS-REFERENCE TO RELATED APPLICATIONS

This application claims priority under 35 U.S.C. 119 of U.S. provisional application Ser. No. 60/045,388, filed May 20, 1997 and of Danish application Serial No. 0468/97 filed Apr. 28, 1997, the contents of which are fully incorporated herein by reference.

The present invention relates to a new method of manufacturing a fabric or a garment with a stone-washed or worn look resulting in no or very limited strength loss of said fabric or garment.

BACKGROUND OF THE INVENTION

The popularity of denim fabrics among consumers of all ages has been well documented by sales in a large number of countries throughout the world.

Denim is most often cotton cloth. A conventional dyestuff for denim is the dye indigo having a characteristic blue colour, the indigo-dyed denim cloth having the desirable characteristic of alteration of dyed threads with white threads which upon normal wear and tear gives denim a white on blue appearance.

A popular look for denim is the stone-washed or worn look. Traditionally stone-washing has been performed by laundering the denim material or garment in the presence of pumice stones which results in fabric having a faded or worn appearance with the desired white on blue contrast appearance described above. This stone-washed look primarily consists of removal of dye in a manner to yield a material with areas which are lighter in colour, while maintaining the desirable white on blue contrast, and a material which is softer in texture.

Enzymes, particularly cellulases, are currently used in processing dyed twill fabric, especially denim. In particular cellulolytic enzymes or cellulases have been used as a replacement for or in combination with pumice stones for the traditional "stone-washing" process to give denim a faded look. Use of cellulases to stone-wash has become increasingly popular because use of stones alone have several disadvantages. For example, stones used in the process cause wear and tear on the machinery, they cause environmental waste problems due to the grit produced and result in high labour costs associated with the manual removal of the stones from pockets of garments. Consequently, reduction or elimination of stones in the wash may be desirable.

Contrary to the use of pumice stones, enzymes, in particular cellulases, are safe for the machinery, result in little or no waste problem and drastically reduced labour costs.

However, many cellulases have an activity towards insoluble cellulose which may result in a reduced strength of the cellulosic fabric in question.

It is an object of the present invention to create an enzymatic process for manufacturing a fabric or a garment with a "stone-washed" look, a "worn" look or any other fashion look known in the art based on providing fabric or garments with localized variation in colour density, wherein the used enzyme has no or only a very low activity towards insoluble cellulose. In particular, it is an object of the present invention to create an enzymatic process for manufacturing a fabric or a garment with a "stone-washed" look, a "worn" look or any other fashion look known in the art by coating the yarn or fabric or garment with a polymer prior to dyeing and afterwards creating the abraded or worn look by degradation of the polymer coating.

SUMMARY OF THE INVENTION

It has now surprisingly been possible to manufacture a fabric or a garment with a stone-washed or worn look wherein the manufacturing methods result in a very limited strength loss of the fabric or garment involved.

Accordingly, the present invention relates to a method of manufacturing, with a very limited strength loss, a fabric with a stone-washed or worn look comprising (a) coating the yarn with a biodegradable polymer by contacting the yarn with a solution of said polymer;
(b) dyeing the yarn;
(c) optionally coating the yarn with a sizing agent;
(d) weaving the yarn into a fabric;
(e) optionally desizing the fabric; and
(f) treating the fabric with an effective amount of an enzyme in an aqueous medium, wherein said enzyme is capable of degrading the biodegradable polymer, and has no or only a low activity towards insoluble cellulose.

Another embodiment of the present invention relates to a method of manufacturing, with a very limited strength loss, a fabric with a stone-washed or worn look comprising (a) coating the fabric with a biodegradable polymer by contacting the fabric with a solution of said polymer;
(b) dyeing the fabric;
(c) treating the fabric with an effective amount of an enzyme in an aqueous medium, wherein said enzyme is capable of degrading the biodegradable polymer, and has no or only a low activity towards insoluble cellulose; and
(d) optionally cutting and sewing the fabric into a garment.

Another embodiment of the present invention relates to a method of manufacturing, with a very limited strength loss, a garment with a stone-washed or worn look comprising (a) coating the yarn with a biodegradable polymer by contacting the yarn with a solution of said polymer;
(b) dyeing the yarn;
(c) optionally coating the yarn with a sizing agent;
(d) weaving the yarns into a fabric;
(e) cutting and sewing the fabric into a garment;
(f) optionally desizing the garment; and
(g) treating the garment with an effective amount of an enzyme in an aqueous medium, wherein said enzyme is capable of degrading the biodegradable polymer, and has no or only a low activity towards insoluble cellulose.

Another embodiment of the present invention relates to a method of manufacturing a garment, with a very limited strength loss, with a stone-washed or worn look comprising (a) coating the fabric with a biodegradable polymer by contacting the fabric with a solution of said polymer;
(b) dyeing the fabric;
(c) cutting and sewing the fabric into a garment; and
(d) treating the garment with an effective amount of an enzyme in an aqueous medium, wherein said enzyme is capable of degrading the biodegradable polymer, and has no or only a low activity towards insoluble cellulose.

Another embodiment of the present invention relates to a method of manufacturing, with a very limited strength loss, a garment with a stone-washed or worn look comprising (a) coating the garment with a biodegradable polymer by contacting the fabric with a solution of said polymer;
(b) dyeing the garment;
(c) treating the garment with an effective amount of an enzyme in an aqueous medium, wherein said enzyme is capable of degrading the biodegradable polymer, and has no or only a low activity towards insoluble cellulose.

DETAILED DESCRIPTION OF THE INVENTION

According to the present invention the first step in this new method of manufacturing a fabric or a garment with a stone-washed or a worn look is to coat the yarn or fabric or garment with a biodegradable polymer.

A characteristic feature of the polymer for use in this invention is that it should be able to bind tightly to the surface of the fibers, yarns, fabrics or garments in question.

The biodegradable polymer may typically be a xyloglucan polymer, because xyloglucan binds very strongly to cellulose.

Xyloglucans

Xyloglucans occur widely in the primary walls of higher plant cells, where they are bound in close association with cellulose microfibrils.

Xyloglucans are linear chains of (1→4)β-D-glucan, but, unlike cellulose, they possess numerous xylosyl chain units added at regular sites of the O-6 position of the glucosyl units of the chain (Carpita, N. C. & Gibeaut, D. M. (1993): The plant Journal, 3, pp 1–30).

Species-specific differences occur as to the distribution of additional branching fucosyl-galactosyl residues (Hayashi, T. & Maclachlan, G. (1984): Plant Physiol., 75, pp 596–604). For instance, tamarind xyloglucan is not fucosylated (Vincken, J.-P. (1996): Enzymic modification of cellulose-xyloglucan networks, Thesis Wageningen Agricultural University).

Commercially available xyloglucan may be purchased in a purified form from Megazyme (Australia) or as raw tamarind kernel powder from Polygal (POLYGUM 55).

According to the present invention xyloglucan obtained from monocotyledons and/or dicotelydons are preferred, in particular tamarind seeds.

The xyloglucan used according to the invention may also be a chemically or enzymatic modified xyloglucan.

Coating with a Biodegradable Polymer

According to the invention the yarn or fabric or garment is contacted with a solution of a biodegradable polymer. This may be done in the following way:

Initially a biodegradable polymer solution (e.g. a xyloglucan solution) is prepared, the concentration of which depends on the purity of the biodegradable polymer. Typically the biodegradable polymer solution has a concentration of from about 0.05% (w/v) to about 50% (w/v).

Purified xyloglucan solutions may be prepared in concentrations ranging from about 0.05% (w/v) to about 10% (w/v).

Crude xyloglucan solutions, e.g., in the form of tamarind kernel powder, may be prepared in concentrations ranging from 0.25%–50% (w/v).

The xyloglucan may be added to the warp thread by methods usually applied for warp sizing such as in a conventional slasher, as foam in a horizontal pad system, as foam in a knife-over-roll system, or alternatively using similar wet out or rinse boxes normally applied prior to dyeing.

The coating may be performed prior to the wet out, simultaneously with the wet out or after the wet out procedure.

Depending on the purity of the xyloglucan source a rinse procedure may be included prior to dyeing. A xyloglucan source like crude tamarind kernel powder will contain non-xyloglucan impurities like pectin, starch, protein, fat and waxes which may have a negative impact on the adsorption of the dye. The rinse may be a hot or a cold rinse in water, optionally containing a surfactant (e.g. 0.05–5 g/l).

Dyeing

The next step in the method according to the invention is the dyeing of the yarn or fabric or garment.

Preferably the dyeing of the yarn is a ring-dyeing. A preferred embodiment of the invention is ring-dyeing of the yarn with a vat dye such as indigo, or an indigo-related dye such as thioindigo, or a sulfur dye, or a direct dye, or a reactive dye, or a naphthol. The yarn may also be dyed with more than one dye, e.g., first with a sulphur dye and then with a vat dye, or vice versa.

The indigo may be derived from the indigo plant material, or synthetic, or the biosynthetic indigo available from Genencor International.

The warp thread may be dyed according to methods known in the art, typically by using a continuously process in which the yarn is repeatedly dipped into dye-baths containing the dye in question (e.g. indigo in reduced (leuco) form). Following each dip, the indigo is oxidized by exposing the thread to oxygen (a process known as skying). Alternatively the indigo may be oxidized with other oxidizing agents as known in the art.

The dyeing may be carried out in the following way: Initially the dry warp thread is pre-wetted, typically the wet out mix contains a wetting agent, a chelating agent and sodium hydroxide.

The dye-bath may typically have the following composition:

4 kg Indigo rein BASF Pulver K 0.2 kg Primasol FP (from BASF)

30 l water preheated to 70–80° C.

6.5 l Sodium hydroxide 38° Bé

3 kg sodium hydrosulfite

The volume is adjusted to 50 l, and the solution is hold at 50° C. for 30 min.

From this stock solution a 1000 l dye-bath can be prepared:

940 l water

2–3 l sodium hydroxide 38° Bé

1.5–2 kg sodium hydrosulfite 0.5–1 kg Setamol WS (from BASF)

50 l stock solution.

The warp thread may then be dipped in the dye-bath for 5–60 sec, squeezed, and oxidized in the air for 1–3 min. The treatment may be performed as 4-dip, 8-dip, or other degrees of treatment as known in the art.

After the dyeing operation the dyed yarns are optionally sized before they are woven.

Sizing Agents

The size may be any sizing agent known in the art, e.g., derived from natural polymers, such as starches, modified starches, starch derivatives or cellulose derivatives, or synthetic polymers, such as polyvinyl alcohol, polyvinyl acetate etc.

The yarns are then made into fabrics as known in the art.

Fabrics

The invention is most beneficially applied to cellulose-containing or cellulosic fabrics, such as cotton, viscose, rayon, ramie, linen, lyocell (e.g. Tencel, produced by Courtaulds Fibers), or mixtures thereof, or mixtures of any of these fibres, or mixtures of any of these fibres together with synthetic fibres (e.g. polyester, polyamid, nylon) or other natural fibers such as wool and silk. In particular, the fabric is a twill, preferably denim.

After the weaving the fabric is optionally cut and sewn into a garment.

If the garment or fabric were sized they may now undergo a desizing process as known in the art.

The Desizing Process

In a preferred process of the invention, conventional desizing enzymes, in particular amylolytic enzymes, are used in order to remove starch-containing size.

Therefore, an amylolytic enzyme, preferably an α-amylase, may be added during the process of the invention. Conventionally, bacterial α-amylases are used for the desizing, e.g., an α-amylase derived from a strain of Bacillus, particularly a strain of *Bacillus licheniformis,* a strain of *Bacillus amyloliquefaciens,* or a strain of *Bacillus stearothermophilus;* or mutants thereof. Examples of suitable commercial α-amylase products are Termamyl™, Aquazym™ Ultra and Aquazym™ (available from Novo Nordisk A/S, Denmark) However, also fungal α-amylases can be used. Examples of fungal α-amylases are those derived from a strain of Aspergillus. Other useful α-amylases are the oxidation-stable α-amylase mutants disclosed in WO 95/21247.

The amylolytic enzyme may be added in amounts conventionally used in desizing processes, e.g. corresponding to an α-amylase activity of from about 100 to about 10,000 KNU/l. Also, in the process according to the present invention, 1–10 mM of $Ca^{++}$ may be added as a stabilizing agent.

The fabric or garment may be desized in the following way:

If starch is used as sizing agent an amylase may be applied as desizing agent: The processing conditions may be 60–70° C. and pH 6–8 for 10–15 min, using 2–3 g Aquazyme 120L (from Novo Nordisk A/S)/l at a liquor ratio from 5:1–10:1.

A wetting agent compatible with the amylase may be added to wash liquor.

Several other desizing methods known in the art may alternatively be applied.

Before the finishing process (e.g. the "stone-washing" process) is applied a hot or cold rinse may optionally be included.

The finishing process step according to the invention is performed by using an enzyme which is capable of degrading the biodegradable polymer. An example of such an enzyme is a xyloglucanase.

Xyloglucanases

According to the present invention a xyloglucanase is defined as any enzyme which has an activity towards the substrate xyloglucan.

Preferably the xyloglucanase according to the invention is produced by micro-organisms such as fungi or bacteria.

Examples of useful xyloglucanases are family 12 xyloglucan hydrolyzing endoglucanases, in particular family 12 xyloglucan hydrolyzing endoglucanases, obtained from e.g. *Aspergillus aculeatus* as described in WO 94/14953. Another useful example is a xyloglucanase produced by Trichoderma, especially EGIII.

The xyloglucanase may also be an endoglucanase with xyloglucanase activity and low activity towards insoluble cellulose and high activity towards soluble cellulose, e.g., family 7 endoglucanases obtained from, e.g., *Humicola insolens.*

The used xyloglucanase may also be an enzyme which activity has been enhanced by adding a cellulose binding domain to said enzyme.

According to the present invention the enzyme which is capable of degrading the biodegradable polymer may be added at a concentration of 0.1–25000 μg enzyme protein/g fabric or garment, preferably 0.1–10000 μg enzyme protein/g fabric or garment, more preferably 0.5–1000 μg enzyme protein/g fabric or garment, in particular 0.5–500 μg enzyme protein/g fabric or garment.

Finishing Process

The chosen procedure will depend on the enzyme in question. If a xyloglucan hydrolyzing endoglucanase from *Aspergillus aculeatus,* described in WO 94/14953, is used the processing conditions could be 30–60° C., pH 3–6 for 10–120 min, using 0.5 mg enzyme/g fabric at a liquor ratio from 4:1–20:1.

A surfactant compatible with the enzyme may be added to wash liquor (e.g. Novasol P from Novo Nordisk A/S).

Alternatively the process may be performed using a combination of a xyloglucan hydrolyzing endoglucanase and 0.25–1 kg pumice stones/per kg jeans. Similar conditions as described above. If pumice stones are used there may be a reduced strength of the fabric or garment in question.

The denim processing may be performed in any machinery known in the art such as washer extractors (front or side loaded) or Barrel Washers. Optionally, a hot or cold rinse may be included.

Inactivation should be performed in order to obtain sufficient denaturation of the used enzyme. Inactivation conditions may be 70–100° C. for 10–20 min. at pH above 9.5, but the inactivation conditions will of course depend on the specific enzyme in use.

Additional finishing processes may be carried out as known in the art in order to clean up the fabric or obtain a lighter blue shade.

A mild hydrogen peroxide bleaching may be performed to clean up the fabric using 1.5 g 35% hydrogen peroxide/l and 1 g soda ash/l at a pH above 10 for 10–20 min. at a temperature in the range between 60–80° C. In addition a sequestering agent (stabilizer) may be added, e.g. sodium silicate. A hot rinse is recommended subsequent to bleaching, and surfactants may be added.

To obtain a lighter blue shade a hypochlorite bleaching may be performed, using 8 g sodium hypochlorite/l and 1 g soda ash/l at pH 9–11 for 10 min. at 50° C. After a rinse a neutralization is carried out using 1.5 g sodium metabisulphite/l for 10 min. at 50° C. A short rinse is recommended which may contain surfactants.

Optionally other finishing agents such as brightening agents or softening agents may be used.

Xyloglucanase Activity

Xyloglucanase activity may be measured as stated below:

A: Determination of residual sugar: (According to Vincken, J.-P. (1996): Enzymic modification of cellulose-xyloglucan networks, Thesis Wageningen Agricultural University, pp 13) A purified source of xyloglucan (e.g. from Megazyme, Australia) is dissolved in a suitable buffer (250 μg xyloglucan in 100 μl buffer) and incubated with 30–400 ng of enzyme for 1 or 20 h. The increase in reducing sugar is determined according to the procedure of Somogyi using glucose for calibration.

Other methods for determination of reducing sugar may be performed as stated in Methods in Enzymology, vol. 160 (Ed. Wood, W. A. & Kellogg, S. T. (1988), Academic Press Inc., pp 87–112), in which enzyme concentrations and incubation time should be adjusted to be within the sensitivity range of the analysis.

B: Release of dyed soluble fragments:

An azurine dyed and crosslinked xyloglucan substrate (AZCL-xyloglucan) may be obtained from Meazyme Australia. 0.2 w/v % xyloglucan solution is prepared in a suitable buffer. Incubation between 15–60 min. with 0.005–1 w/v % enzyme. Enzyme activity is measured as release of blue soluble fragments after centrifugation, determined as the absorbance at 620 nm in the supernatant.

Amylolytic Activity

The amylolytic activity may be determined using potato starch as substrate. This method is based on the breakdown of modified potato starch by the enzyme, and the reaction is followed by mixing samples of the starch/enzyme solution with an iodine solution. Initially, a blackish-blue colour is formed, but during the break-down of the starch the blue colour gets weaker and gradually turns into a reddish-brown, which is compared to a coloured glass standard.

One Kilo Novo alfa Amylase Unit (KNU) is defined as the amount of enzyme which, under standard conditions (i.e. at 37° C. +/− 0.05; 0.0003 M $Ca^{2+}$; and pH 5.6) dextrinizes 5.26 g starch dry substance Merck Amylum solubile.

The present invention is further illustrated in the following example which is not in any way intended to limit the scope of the invention as claimed.

EXAMPLE 1

Reflection Measurements

The reflection measurements which define the look of the fabric according to the invention were performed at a wavelength of 420 nm using a reflectometer having a measuring diaphragm with a diametrical dimension of 27 mm (Texflash 2000 from Datacolor International, light source D65). All reflection measurements are expressed in % related to a white standard (100% reflection).

The white standard used was a Datacolor International serial no. 2118 white calibration standard.

For calibration purposes a black standard was also used (no. TL-4-405)

Evaluation: The higher the value the lighter the colour.

Warp tear strength

Standard test method for tear resistance for woven fabrics by falling-pendulum (Elmendorf Apparatus, ASTM D 1424, using a Elmendorf Tearing Tester, Twing-Albert Instrument CO., Philadelphia, USA 19154). However, due to the very high strength of twill fabric, the dimensions of the cutting die have been reduced to 102 mm×55 mm. Conditioning of the fabric has been accomplished at 20° C. and 60% RH for 24 hours prior to testing.

Weight Loss/Gain

Conditioning of the fabric has been accomplished at 20° C. and 60% RH for 24 hours prior to weighing.

EXPERIMENTAL

| Scouring: | |
|---|---|
| Fabric: | 1 kg Greige cotton duck, style no. 426 (Test Fabrics Inc). |
| Apparatus: | Washing machine, Wascator FL 120 (Electrolux) |
| Scouring: | 3% of NaOH, 0.5 g Inkmaster 750/1 (Rhone Poulenc). 90° C., 60 min., 12 l de-ionised water. |
| Neutral.: | 2% of 100% acetic acid 50° C., 10 min., 12 l de-ionised water. |
| Rinse: | Two times in 12 l de-ionised water |

| Coating of scoured swatches with Polygum 55 (POLYGAL ag Switzerland): | |
|---|---|
| Fabric: | 13 × 24 cm swatches prepared from the scoured fabric. |
| Polygum: | 500 ml of three different Polygum 55 (POLYGAL) solutions (0 w/v %, 1.0 w/v % and 5.0 w/v %). Polygum 55 is dissolved in de-ionised water by heating to approx. 90° C. and stirred cold over night (magnetic stirrer). |
| Coating: | 6 swatches are incubated in each concentration of Polygum for 30 min at room temperature. Pressed using a wringer (Jupiter from DSW). The swatches are drip-dried. |
| Rinse: | Removal of impurities is carried out by a rinse in Wascator FL 120 (Electrolux): A hot rinse in 32 l 55° C. de-ionised water for 5 min. and two cold rinses in 32 l 15° C. de-ionised water for 5 min. The swatches are drip-dried. |
| Evaluation: | Polymer uptake and polymer uptake after rinse is determined as weight gain as described above prior and subsequent to the rinse procedure, respectively. |

Indigo Dyeing of Coated Swatches:

Stock solution:

8 g indigo (BASF)

0.4 g Primasol FP (BASF)

60 ml de-ionised water 50° C. (stirring for two hours at 50° C.)

0.6 g NaOH 6.0 g sodium hydrosulfite

Final dyebath:

100 ml stock solution 1.5 g Setamol WS (BASF)

3.5 g sodium hydrosulfite 5 ml 50% NaOH 1880 ml de-ionised water

Procedure:

Four coated swatches per Polygum 55 concentration are applied in the dyeing procedure. The coated swatches are pre-wetted in 11 5 g Setamol WS/l (BASF) for 5–10 min. and squeezed using a wringer (Jupiter from DSW). The swatches are dipped in the dyebath for 20 sec., squeezed and oxidised in the air for 120 sec. This sequence is repeated additional 6 times (7-dip). The swatches are pressed and drip-dried over night. Surplus indigo is removed by rinsing in wascator FL 120 (Electrolux): A hot rinse in 32 l 55° C. de-ionised water for 5 min. and two cold rinses in 32 l 15° C. de-ionised water for 5 min.

Evaluation:

Dye uptake (determined as reflection as described above) with six determinations/swatch.

| Enzyme treatment of indigo dyed coated swatches: | |
|---|---|
| Apparatus: | Launder-O-meter LP2 (Atlas Electric Devices Company) |
| Fabric : | Indigo dyed coated swatches are sewed together to form a tube which is placed in the Launder-O-meter beaker, 1 swatch per beaker. Approx. 18 g/swatch. |
| Buffer: | 50 ml 50 mM citric acid, pH 5.0 is added to each beaker. |
| Enzyme: | a xyloglucanase (family 12 xyloglucan hydrolyzing endoglucanase) obtained from *Aspergillus aculeatus* as described in WO 94/14953. The enzyme is dosed according to the experimental outline. |
| Time: | 60 min. |
| Temperature: | 50° C. |
| Abrasive aid: | 30 steel nuts (d. 16 mm), 10 steel nuts (d. 10 mm), 10 star shaped magnets (5 g), 3 star shaped magnets (3 g) are added to each beaker and placed inside the fabric tube. |

-continued

| Enzyme treatment of indigo dyed coated swatches: | |
|---|---|
| Rinse: | 2 times in 5 l de-ionised water for 5 min.; tumble dried. |
| Evaluation: | Abrasion is measured on the fabric side facing the interior of the launderometer beaker (determined as reflection as described above) with six determinations/swatch; Delta refl. is calculated as (abrasion - dye uptake). Tear strength as described above, three determinations/swatch. |

| Swatch no. | Coating with Polygum 55 | +/− 6 mg xyloglucanase/ g textile |
|---|---|---|
| 1–2 | 0 w/v % | − |
| 3–4 | | + |
| 11–12 | 1 w/v % | − |
| 13–14 | | + |
| 17–18 | 5 w/v % | − |
| 19–20 | | + |

RESULTS

The results from the above described Polygum 55 coating experiment are outlined in Table 1.

TABLE 1

| Conc. of Polygum 55 | 0 w/v % | 1.0 w/v % | 5.0 w/v % |
|---|---|---|---|
| Polymer uptake %, initial | 0 | 0.96 | 3.70 |
| Polymer uptake %, after rinse | 0 | 0.44 | 1.20 |

The polymer uptake increases with increasing concentration of Polygum 55 in the coating bath. Excess polymer is removed during the rinse procedure.

The results from the dyeing and finishing procedure are shown in Table 2. When excess polymer is sufficiently removed in a rinse procedure the dye uptake is only slightly affected by the polymer concentration, and the dye is evenly distributed on the fabric. For each concentration of Polygum 55 a higher abrasion level is obtained when a xyloglucanase has been added during the incubation, compared to a treatment without enzyme, thus resulting in a higher delta reflection (delta refl.). Hence, it is possible to obtain the desired abraded look on indigo dyed twill by using the new twill manufacturing dyeing method. Surprisingly, the increase in delta reflection is not accompanied by a concomitant strength loss.

TABLE 2

| Swatch no. | Coating with Polygum 55 | Dye uptake | +/− xylo-gluca-nase | Abrasion After LOM | delta refl. | Tear strength (N) |
|---|---|---|---|---|---|---|
| 1–2 | 0 w/v % | 3.23 | − | 4.01 | 0.78 | 25.06 |
| 3–4 | | 2.99 | + | 4.06 | 1.07 | 23.81 |
| 11–12 | 1 w/v % | 2.35 | − | 2.93 | 0.58 | 25.53 |
| 13–14 | | 2.43 | + | 3.74 | 1.30 | 25.01 |
| 17–18 | 5 w/v % | 3.09 | − | 3.89 | 0.79 | 24.38 |
| 19–20 | | 3.01 | + | 4.33 | 1.33 | 24.28 |

I claim:

1. A method of providing a yarn, fabric, or garment with a stone-washed or worn look, said method comprising:

(a) dyeing the yarn, fabric, or garment; and (b) treating the dyed yarn, fabric, or garment with an effective amount for producing a stone-washed or worn look of an enzyme, wherein said enzyme is a family 12 xyloglucan hydrolyzing endoglucanase obtained from *Aspergillus aculeatus*.

2. A method as defined in claim 1, wherein the xyloglucan hydrolyzing activity of said enzyme has been enhanced by adding a cellulose binding domain to said enzyme.

3. A method as defined in claim 1, wherein said enzyme is added to said yarn, fabric, or garment at a concentration of 0.1–10000 $\mu$g enzyme protein/g yarn, fabric, or garment.

4. A method as defined in claim 3, wherein said enzyme is added to said yarn, fabric, or garment at a pH from about 2 to about 7 and at a temperature from about 30° C. to about 70° C.

5. A method as defined in claim 1, wherein said dyeing step is achieved by ring dyeing.

6. A method as defined in claim 1, wherein said dyeing step is achieved using a dye selected from the group consisting of a vat dye, a sulfur dye, a direct dye, a reactive dye, a naphthol, and combinations of any of the foregoing.

7. A method as defined in claim 6, wherein said vat dye is indigo.

8. A method as defined in claim 1, wherein said fabric is a cellulosic material selected from the group consisting of twill and denim.

9. A method as defined in claim 1, further comprising, prior to said dyeing step, coating the yarn, fabric, or garment with a xyloglucan polymer.

10. A method as defined in claim 9, wherein said xyloglucan polymer is obtained from monocotyledons and/or dicotelydons.

11. A method as defined in claim 10, wherein the xyloglucan polymer is obtained from tamarind seeds.

12. A method as defined in claim 9, wherein said coating is achieved using an aqueous solution of said xyloglucan polymer in which said polymer is present at a concentration of from about 0.05% (w/v) to about 50% (w/v).

13. A method as defined in claim 12, wherein said solution is applied to said yarn, fabric, or garment at a temperature from about 15° C. to 90° C. and at a pH from about 1 to about 12.

14. A method as defined in claim 1, further comprising, prior to said treating step:

(i) coating the yarn, fabric, or garment with a sizing agent; and (ii) subjecting the coated yarn, fabric, or garment to a desizing treatment.

15. A method as defined in claim 14, wherein said sizing agent is a natural polymer.

16. A method as defined in claim 15, wherein the sizing agent is starch.

17. A method as defined in claim 16, wherein the desizing treatment is achieved using an amylase.

18. A method as defined in claim 1, further comprising subjecting the yarn, fabric, or garment to a treatment selected from the group consisting of bleaching, over-dyeing, brightening, softening, and anti-wrinkling.

19. A method of providing a yarn, fabric, or garment with a stone-washed or worn look, said method comprising:

(a) coating the yarn, fabric, or garment with a xyloglucan polymer;

(b) dyeing the coated yarn, fabric, or garment; and (c) treating the dyed yarn, fabric, or garment with an effective amount for producing a stone-washed or worn look of an enzyme having xyloglucanase activity.

20. A method as defined in claim 19, wherein said enzyme is a family 12 xyloglucan hydrolyzing endoglucanase obtained from *Aspergillus aculeatus*.

21. A method as defined in claim 19, wherein said enzyme is a family 7 endoglucanase obtained from *Humicola insolens*.

22. A method as defined in claim 19, wherein the xyloglucan hydrolyzing activity of said enzyme has been enhanced by adding a cellulose binding domain to said enzyme.

23. A method as defined in claim 19, wherein said enzyme is added to said yarn, fabric, or garment at a:

(i) concentration of 0.1–10000 $\mu$g enzyme protein/g yarn, fabric, or garment;

(ii) pH from about 2 to about 7; and (iii) temperature from about 30° C. to about 70° C.

24. A method as defined in claim 19, wherein said dyeing step is achieved using a dye selected from the group consisting of a vat dye, a sulfur dye, a direct dye, a reactive dye, a naphthol, and combinations of any of the foregoing.

25. A method as defined in claim 24, wherein said vat dye is indigo.

26. A method as defined in claim 19, wherein said fabric is a cellulosic material selected from the group consisting of twill and denim.

27. A method as defined in claim 19, wherein said xyloglucan polymer is obtained from monocotyledons and/or dicotelydons.

28. A method as defined in claim 19, wherein said coating is achieved using an aqueous solution of said xyloglucan polymer in which said polymer is present at a concentration of from about 0.05% (w/v) to about 50% (w/v), wherein said solution is applied to said yarn, fabric, or garment at a temperature from about 15° C. to 90° C. and at a pH from about 1 to about 12.

29. A method as defined in claim 19, further comprising, prior to said treating step:

(i) coating the yarn, fabric, or garment with a sizing agent; and (ii) subjecting the coated yarn, fabric, or garment to a desizing treatment.

30. A method as defined in claim 29, wherein the sizing agent is starch and the desizing treatment is achieved using an amylase.

31. A method as defined in claim 19, further comprising subjecting the yarn, fabric, or garment to a treatment selected from the group consisting of bleaching, overdyeing, brightening, softening, and anti-wrinkling.

* * * * *